US006798432B2

(12) United States Patent
Fang et al.

(10) Patent No.: US 6,798,432 B2
(45) Date of Patent: Sep. 28, 2004

(54) PRINTING METHOD FOR INTERPOLATING GRAY LEVELS

(75) Inventors: Yu-Fan Fang, Taipei (TW); Kuang-Huei Huang, Taipei (TW)

(73) Assignee: Hi-Touch Imaging Technologies Co., Ltd., Pan-Chiao (TW)

( * ) Notice: Subject to any disclaimer, the term of this patent is extended or adjusted under 35 U.S.C. 154(b) by 0 days.

(21) Appl. No.: 10/063,888

(22) Filed: May 21, 2002

(65) Prior Publication Data

US 2003/0043232 A1 Mar. 6, 2003

(30) Foreign Application Priority Data

Aug. 23, 2001 (TW) ..... 90120707 A

(51) Int. Cl.[7] ..... B41J 2/38
(52) U.S. Cl. ..... 347/183
(58) Field of Search ..... 347/171, 172, 347/188, 19 D, 191, 183, 181; 400/120.01, 120.02, 120.07, 120.09, 120.1, 120.11

(56) References Cited

U.S. PATENT DOCUMENTS 5,131,767 A * 7/1992 Yamada et al. ..... 400/120.07
5,587,732 A * 12/1996 Kokubo ..... 347/183

* cited by examiner

*Primary Examiner*—K. Feggins
(74) *Attorney, Agent, or Firm*—Winston Hsu

(57) ABSTRACT

A method is provided to increase the gray level resolution of a thermal print head. The thermal print head includes a plurality of heaters which are used to heat color dye so as to deposit the color dye on a paper to form a line image. The line image contains a plurality of pixels, each formed by one heater. When generating a pixel, a pulse sequence is fed to one heater to control the heater"s heating period. The pulse sequence contains first and second portions. The first portion contains a plurality of consecutive pulses which is used to generate a first gray level. And the second portion contains at least one empty pulse period followed by at least one pulse which is used to generate a second gray level. The combination of the first and second gray levels will determine the gray level of each pixel of the line image.

15 Claims, 7 Drawing Sheets

PRINTING METHOD FOR INTERPOLATING GRAY LEVELS

BACKGROUND OF THE INVENTION

1. Field of the Invention

The present invention relates to a printing method, and more particularly, to a printing method for interpolating gray levels.

2. Description of the Prior Art

Photo printers are different from general printers. The major difference is that the photo printer can print out an image such as a photo picture on paper with high picture quality. Please refer to FIG. 1 and FIG. 2. FIG. 1 is a diagram of a prior art photo printer 10. FIG. 2 is a simplified exploded view of the photo printer 10 shown in FIG. 1. As shown in FIG. 1, the photo printer 10 has a ribbon 14, a thermal print head 12, a ribbon driver 18, and a roller set 20. The ribbon 14 has a plurality of sectors, and each sector is used for storing one kind of different color dyes. The thermal print head 12 is fixed inside the photo printer 10 for heating the color dyes so that the color dyes are transferred onto a photo paper 16. The ribbon driver 18 is used for moving the ribbon 14 back and forth so that the thermal print head 12 can transfer a specific color dye stored on the ribbon 14 onto the corresponding photo paper 16. The roller set 20 is used for holding the photo paper 16 and moving the photo paper 16 along a predetermined direction. Therefore, the fixed thermal print head 12 is capable of printing a color image on the photo paper 16.

As shown in FIG. 2, the thermal print head 12 has a plurality of heaters 22 that are arranged linearly and spaced equally for heating the ribbon 14. The color dye stored on the ribbon 14 is heated, and is transferred onto the photo paper 16. When the thermal print head 12 starts printing images, each heater 22 positioned on the thermal print head 12 will heat the ribbon 14 so that a plurality of corresponding pixels X1 will form a line image Y1. Then, the photo paper 16 driven by the roller set 20 is moved along the predetermined direction according to a predetermined speed. Therefore, another line image Y2 is printed on the same photo paper 16 next to the line image Y1. Accordingly, a plurality of line images are successfully printed on the same photo paper 16 to complete the printing operation.

As mentioned above, the total number of heaters 22 positioned on the thermal print head 12 determines the corresponding number of the pixels X1 of each line image printed on the photo paper 16. Moreover, the color concentration, that is, the gray level of each pixel X1 printed on the photo paper 16 is determined by the corresponding heater 22 with a specific duration of each heating operation and a total number of heating cycles.

Please refer to FIG. 3A and FIG. 3B. FIG. 3A is a diagram of gray levels and a corresponding driving signal 30 according to the photo printer 10 shown in FIG. 1. FIG. 3B is a diagram of a binary data sequence of the driving signal 30 shown in FIG. 3*a*. As shown in FIG. 3A and FIG. 3B, before the thermal print head 12 of the photo printer 10 starts printing images onto the photo paper 16, all of the heaters 22 positioned on the thermal print head 12 are activated during a predetermined period Tp so that each heater 22 will first approach a predetermined printing temperature. The above-mentioned procedure is called a preheating operation. In addition, the driving signal having a pulse with a binary value "1" will activate the corresponding heater 22, and the driving signal corresponding to a binary value "0" will not activate the heater 22. Next, the photo printer 10 will continuously activate the same heater 22 according to the corresponding gray level of the pixel X1. In other words, each heater 22 positioned on the thermal print head 12 is activated repeatedly according to the desired gray level of the corresponding pixel. The overall heating operation of the heater 22 is represented by a driving signal 30 and its corresponding binary values. Each duration Tu of a pulse 32 is a heating time unit for activating the heater 22. In addition, the energy generated by the heater 22 onto the corresponding pixel X1 during the duration Tu of each pulse 32 is nearly identical. That is, the quantity of color dyes transferred onto the photo paper 16 during the fixed duration Tu is almost identical. The reason why the quantity of color dyes is almost identical is because of a thermal accumulation effect. It is well known that the thermal accumulation effect is adjusted according to a prior art control method so that the quantity of color dyes is controlled with acceptable inaccuracy. A lengthy description of the prior art control method is skipped for brevity.

The heater 22 of the photo printer 10 can produce 256 (0~255) gray levels to print the corresponding pixel X1 with an appropriate gray level. A gray level corresponding to a lightest color concentration is equal to 0, and a gray level corresponding to a darkest color concentration is equal to 255. In other words, when the pixel X1 acquires a corresponding gray level equaling N, which is an integer between 0 and 255, the corresponding heater 22 has to be successively activated N times. Therefore, N pulses 32 of the driving signal 30 are generated repeatedly. That is, N binary "1" values are inputted to the heater 22 continuously. Please note that the photo paper 16 is printed one line at a time. Because each pixel X1 positioned on the same line may have different gray levels, each heater 22 has to wait for 255 durations Tu so that the thermal print head 12 can then print the next line image. That is, one heater 22 finishes printing a corresponding pixel X1 with a smaller gray level within a short time. But, another heater 22 printing a corresponding pixel X1 with a greater gray level may take a long time. When the total number of different gray levels is doubled, each heater 22 has to wait for 511 durations Tu. Therefore, if the number of different gray levels is increased, each heater 22 has to operate for a longer period to complete printing one line image. That is, if the color resolution is improved, the execution time is longer. The printing efficiency, therefore, is greatly deteriorated.

SUMMARY OF INVENTION

It is therefore a primary objective of the claimed invention to provide a printing method for interpolating gray levels of a thermal print head to solve the above mentioned problem.

Briefly, the claimed invention provides a printing method using a thermal print head having a plurality of heaters linearly arranged and equally spaced for heating a dye and transferring the dye onto an object, thereby forming a plurality of pixels corresponding to the heaters on the object. A color of each pixel is determined by a gray level. Each gray level comprises a first portion and a second portion. When controlling the heater to generate a pixel of a predetermined gray level, the printing method comprises activating a heater for a number of cycles corresponding to the first portion of the predetermined gray level, thereby transferring the dye onto the object in a position corresponding to the heater.The first portion is larger than or equal to zero. Each cycle lasts a substantially equal amount of time. Each activation of the heater within a cycle lasts a substantially equal amount of time, and quantity of the dye transferred onto the object is substantially equal for each activation of the heater. The printing method further comprises deactivating the heater for a first predetermined number of cycles corresponding to the second portion of the predetermined gray level, then activating the heater a second predetermined number of cycles corresponding to the second portion of the predetermined gray level. Both the first predetermined number and the second predetermined number are integers larger than or equal to 1. A total quantity of the dye transferred onto the object in printing the second portion of the predetermined gray level is less than the quantity of dye transferred onto the object during each cycle of printing in first portion of the predetermined gray level.

It is an advantage of the claimed invention that the claimed printing method can improve the output picture quality and the printing efficiency of the photo printer by interpolating gray levels based on the thermal accumulation effect.

These and other objectives of the claimed invention will no doubt become obvious to those of ordinary skill in the art after reading the following detailed description of the preferred embodiment which is illustrated in the various figures and drawings.

DETAILED DESCRIPTION

Figure 1:
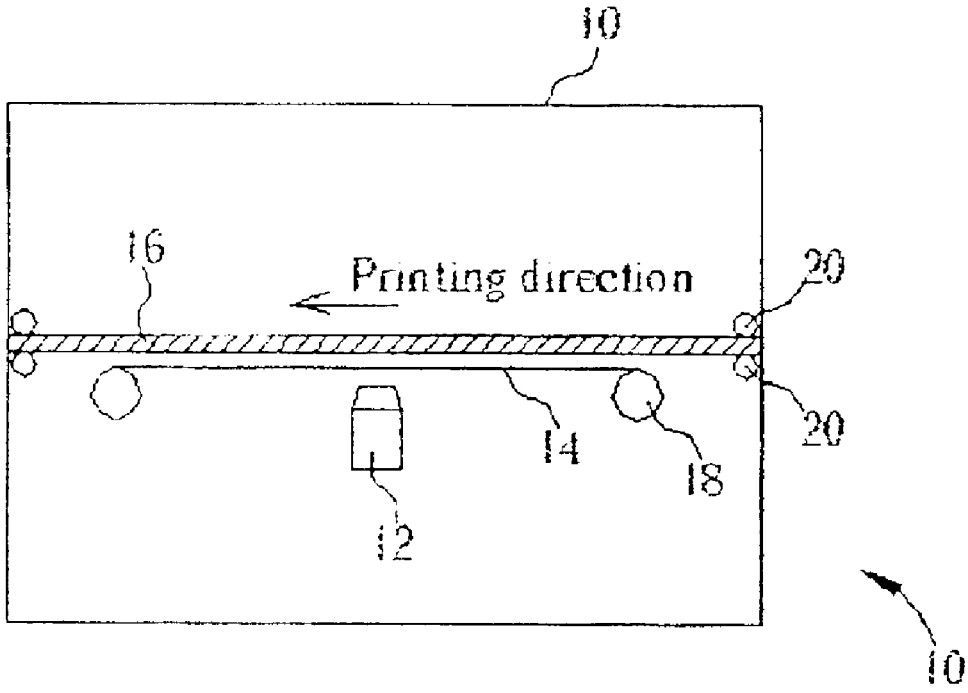
Fig. 1 Prior art
FIG. 1 is a diagram of a prior art photo printer.
Figure 2:
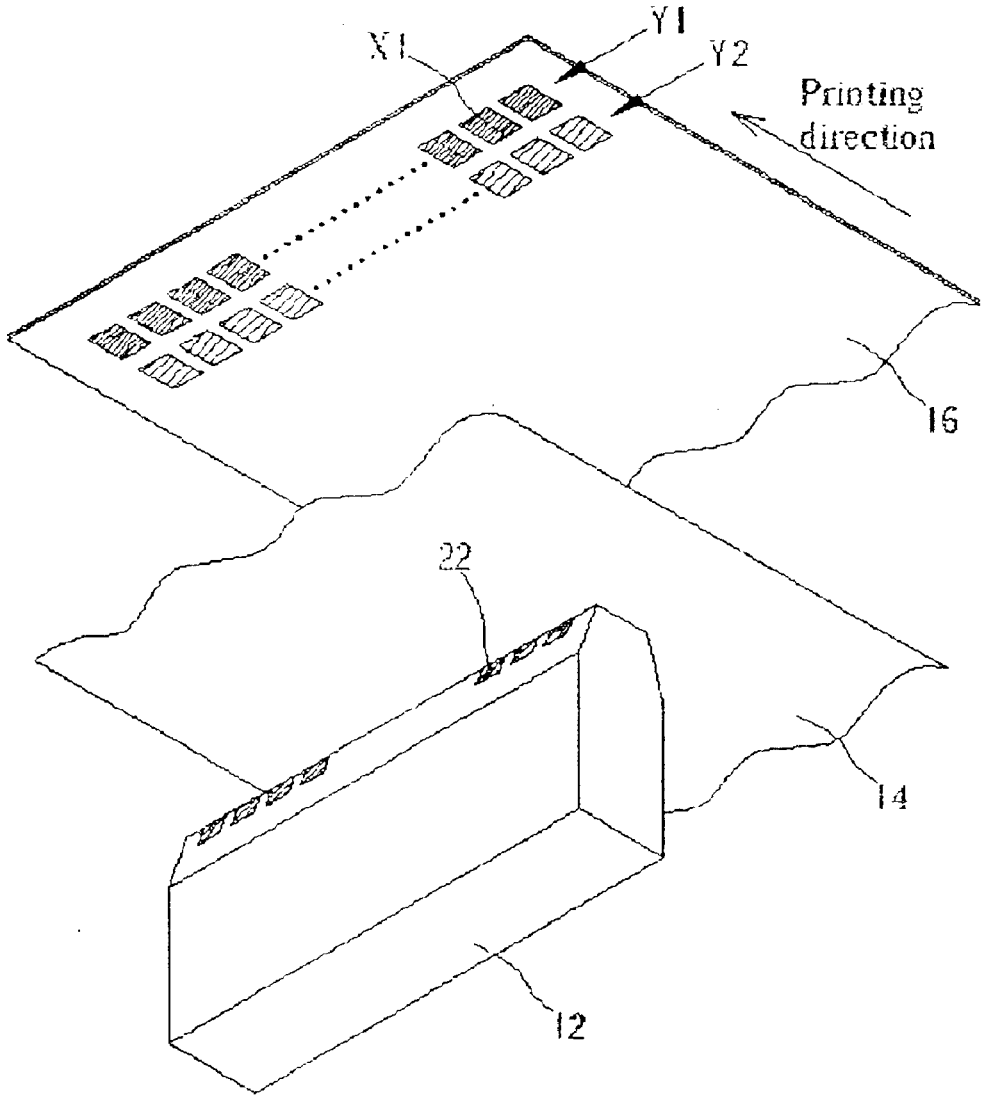
Fig. 2 Prior art
FIG. 2 is a simplified exploded view of the photo printer shown in FIG. 1.
Figure 3A:
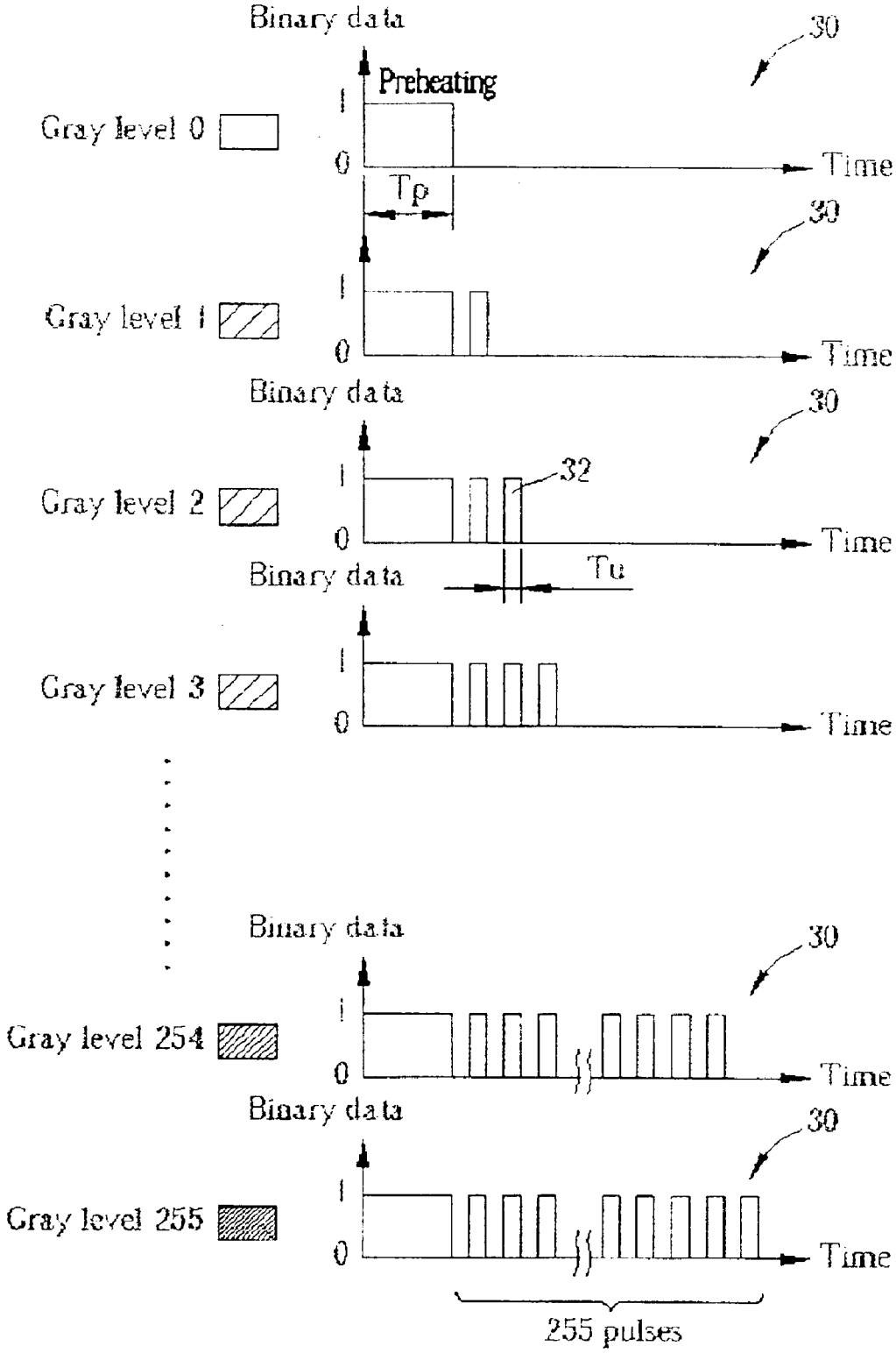
Fig. 3A Prior art
FIG. 3A is a diagram of gray levels and a corresponding driving signal according to the photo printer shown in FIG. 1.
Figure 3B:
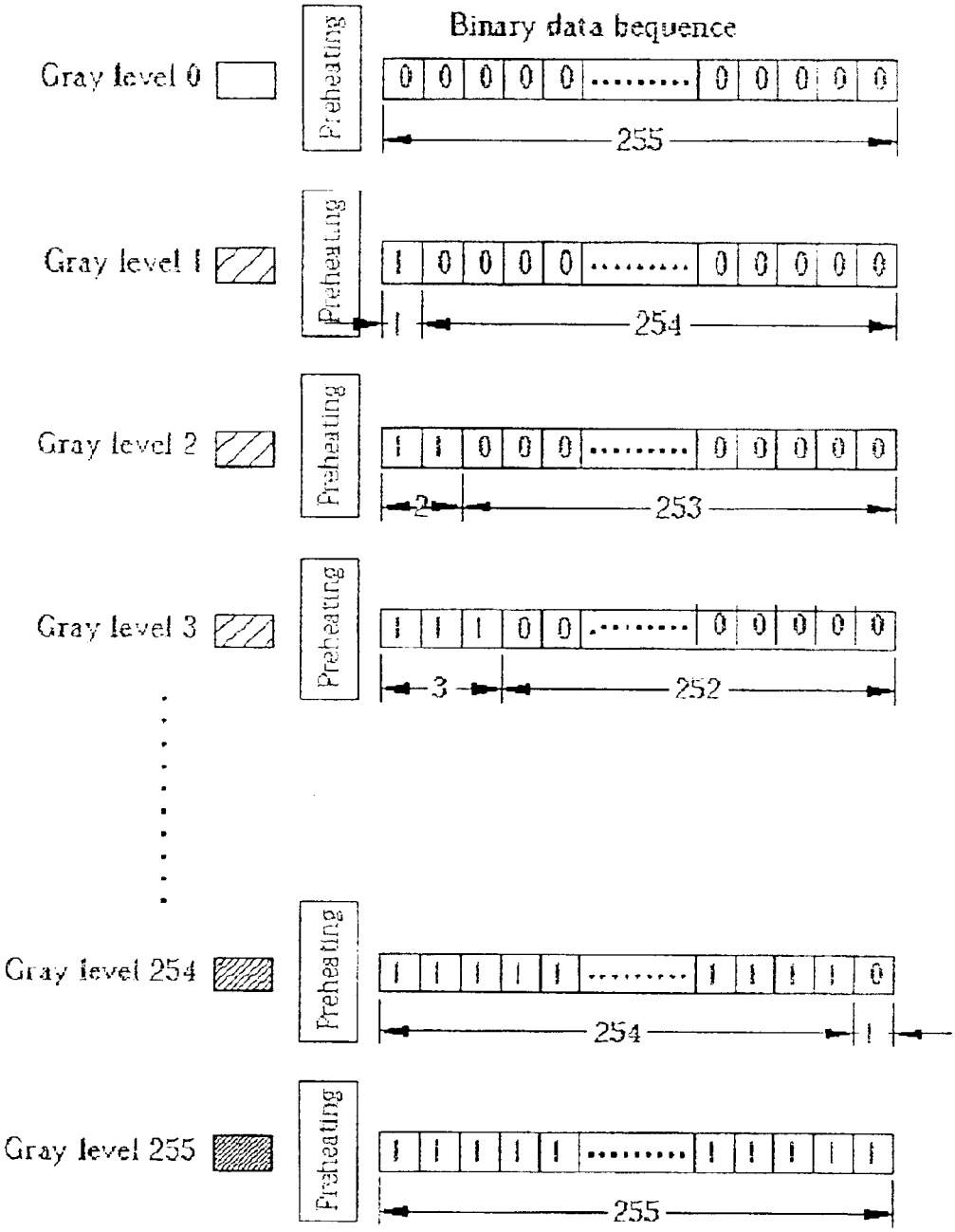
Fig. 3B Prior art
FIG. 3B is a diagram of a binary data sequence of the driving signal shown in FIG. 3*a*.

The structures of the photo printer 10 and the thermal print head 12 according to the present invention are identical to the structures of the prior art photo printer 10 and the prior art thermal print head 12 shown in FIG. 1 and FIG. 2. Therefore, they are not described again for simplicity. As shown in the prior art description, before the thermal print head 12 of the photo printer 10 starts printing images onto the photo paper 16, all of the heaters 22 positioned on the thermal print head 12 are activated during a predetermined period Tp so that each heater 22 will first approach a predetermined printing temperature. For example, the driving signal 30 having a pulse 32 with a binary value "1" will activate the corresponding heater 22, and the driving signal 30 having a binary value "0" will not activate the corresponding heater 22. The above-mentioned procedure is called a preheating operation. Next, the photo printer 10 will continuously activate the same heater 22 according to the corresponding gray level of the pixel X1. In other words, each heater 22 positioned on the thermal print head 12 is activated according to the desired gray level of the corresponding pixel X1.

Figure 4:
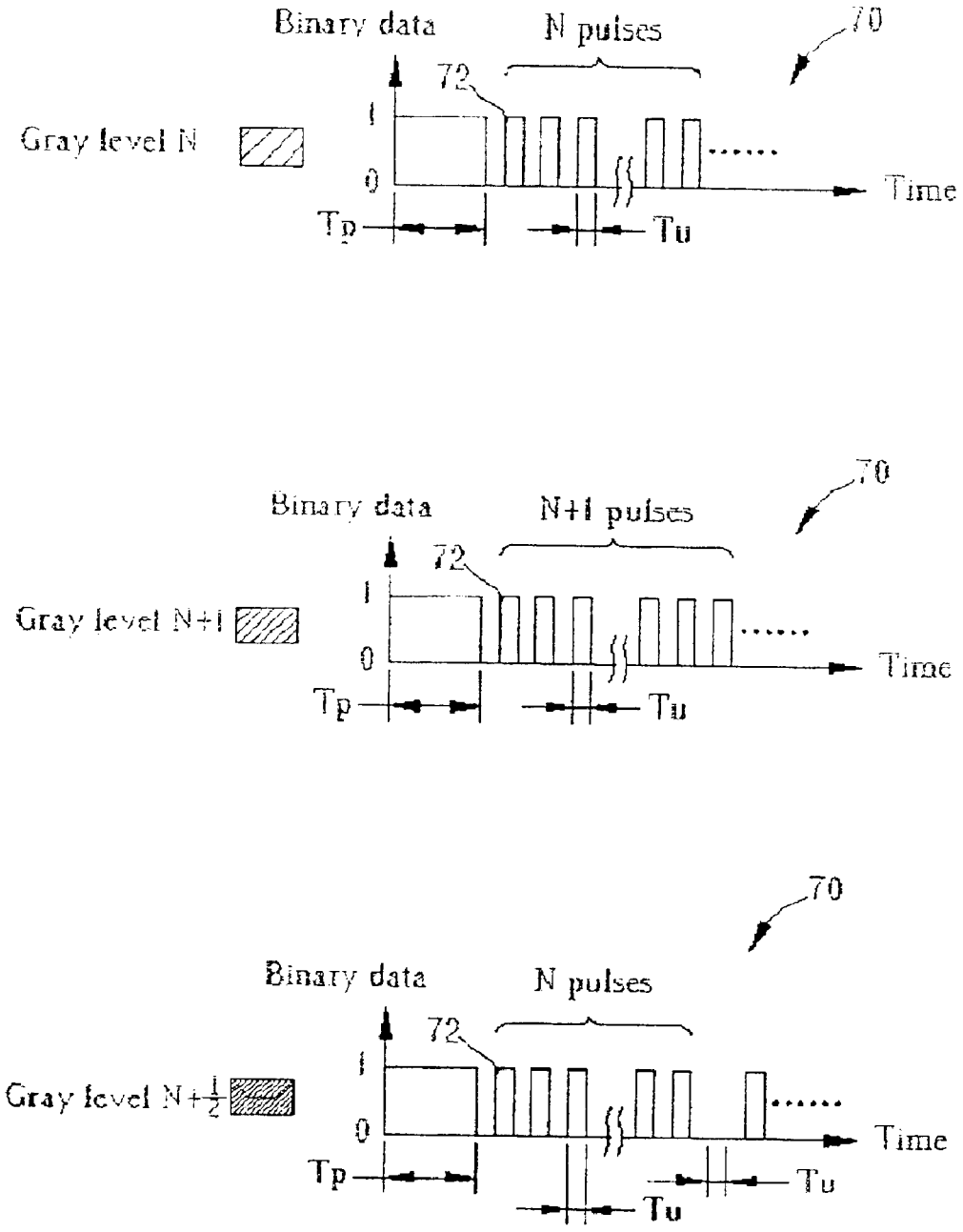
FIG. 4 is a diagram of a first printing method according to the present invention.
Figure 5:
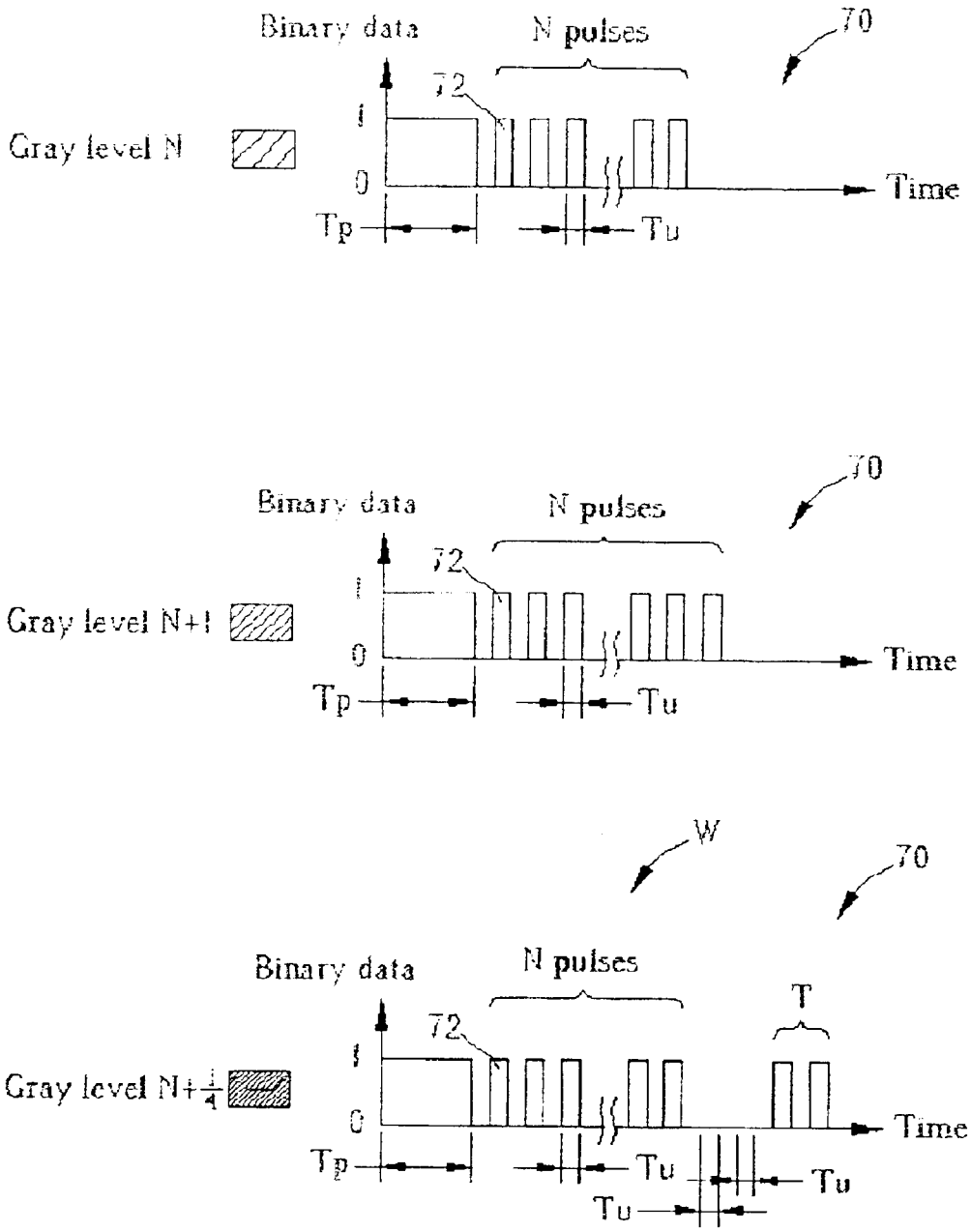
FIG. 5 is a diagram of a second printing method according to the present invention.
Figure 6:
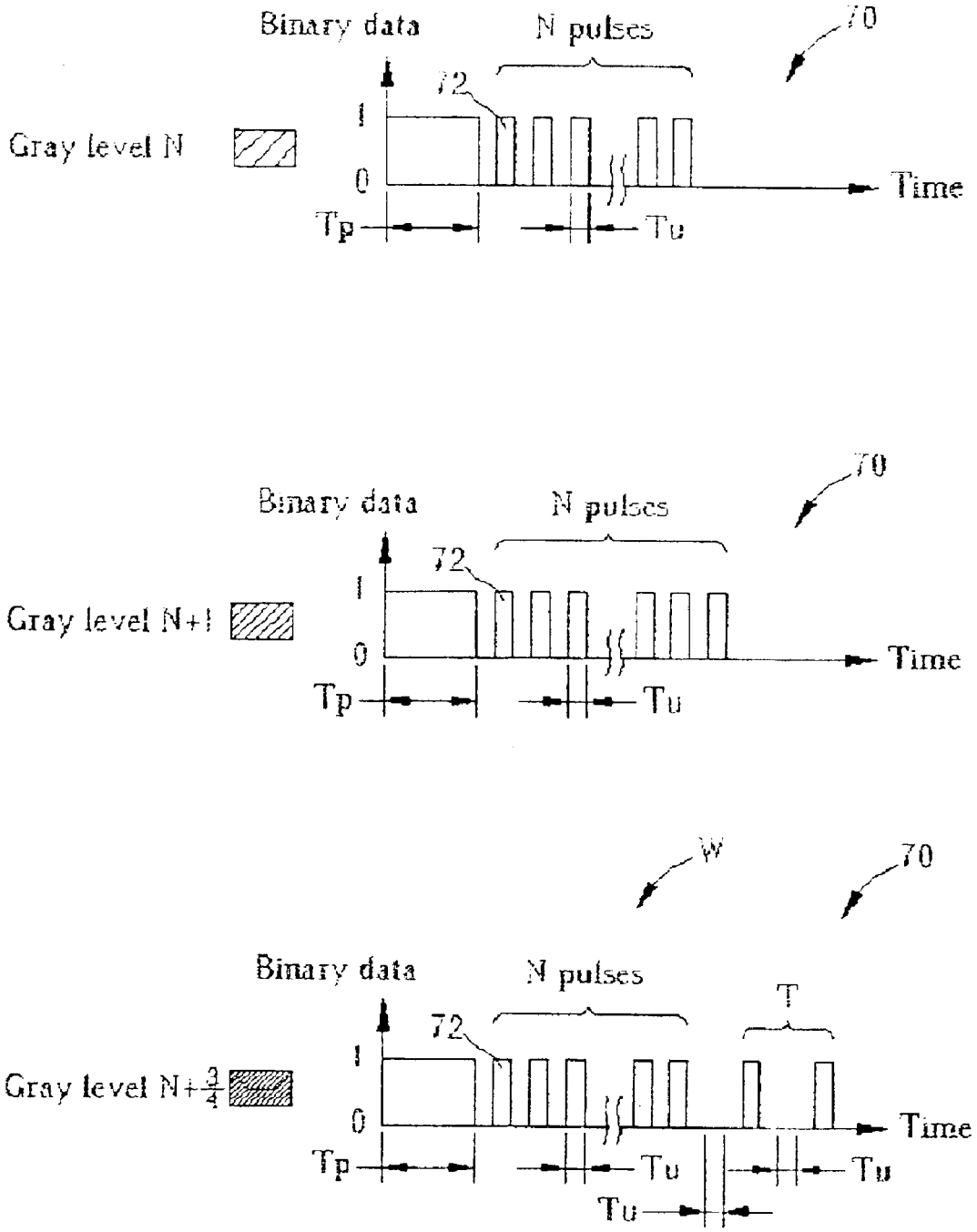
FIG. 6 is a diagram of a third printing method according to the present invention.

Please refer to FIG. 4, FIG. 5, and FIG. 6. FIG. 4 is a diagram of a first printing method according to the present invention. FIG. 5 is a diagram of a second printing method according to the present invention. FIG. 6 is a diagram of a third printing method according to the present invention. The overall heating operation with respect to the heater 22 is represented by a driving signal 70 and its corresponding binary values. Each duration Tu of a pulse 72 is a heating time unit for activating the heater 22. In addition, the energy generated by the heater 22 onto the corresponding pixel X2 within the duration Tu of each pulse 72 is nearly identical. That is, the quantity of color dyes transferred onto the photo paper 16 within the fixed duration Tu is almost identical. The color concentration of each pixel X2 is controlled by a corresponding predetermined gray level. When a plurality of heaters 22 are activated for heating corresponding pixels, the gray level generated by the heater 22 is basically affected by the total number of heating operations imposed on the corresponding pixel X2. In the preferred embodiment, a combination of a first portion W and a second portion T is used for expressing a gray level. The first portion W represents a number with regard to successive activations of the same heater 22. Therefore, the color dye is continuously transferred onto a corresponding pixel X2 of a photo paper 16. The first portion W is greater than or equal to 0. The duration Tu of each pulse 72 is almost identical with acceptable inaccuracy. That is, the quantity of color dyes transferred onto the photo paper 16 is almost the same according to each pulse 72. The second portion T of the gray level corresponds to an interruption of the overall heating process. The heater 22 is deactivated within a duration Tu, and then the heater 22 is activated once or is activated for a number of cycles with the same duration Tu. Within one fixed duration Tu, the quantity of dyes transferred onto the photo paper 16 associated with the second portion T is less than the quantity of dyes transferred onto the photo paper 16 associated with the first portion W. That is, the heating process without any interruptions will output a great deal of energy within one fixed duration Tu for transferring more color dyes onto the corresponding photo paper 16. The result is caused by the thermal accumulation effect as mentioned before. If the total number of times of successively activating the heater 22 is increased, much energy accumulates at the heater 22. Furthermore, the thermal accumulation effect with successive heating operations is greater than the thermal accumulation effect with interruptions induced during original consecutive heating operations. When the heater 22 is deactivated for one duration Tu or a plurality of durations Tu so as to break the consecutive heating operations, the energy generated from the heater 22 to heat the color dyes within the duration Tu is reduced when the heater 22 is activated again. Similarly, when the heater 22 is activated again for heating the color dyes successively, each pulse 72 will have different energy output within the same duration Tu, and the thermal accumulation effect also makes the later pulse 72 with a higher energy output within the same duration Tu as usual.

As shown in FIG. 4, the printing method according to the present invention applies the above-mentioned principle to interpolating gray levels between a gray level with a value N and a gray level with a value "N+1". In the preferred embodiment, heating operations with proper interruptions are combined together for increasing total number of gray levels. The steps are described as follows.

Step 100:

Activate one heater 22 for a predetermined period Tp so that the heater 22 approaches a predetermined temperature required for performing a printing operation properly;

Step 102:

Activate the heater 22 continuously for N times, that is, input successive N pulses to activate the heater 22;

Step 104: Deactivate the heater 22 for one duration Tu;

Step 106: Activate the heater 22 again for one duration Tu or a plurality of durations Tu, that is, input at least one pulse to activate the heater 22 again; and Step 108: Generate one gray level with a value "N+½" to achieve the objective of increasing total number of gray levels.

As mentioned above, the objective of step 100 is to preheat the heater 22 so that the heater 22 can approach a required printing temperature. If the heater 22 is deactivated for one duration Tu after a long heating process, the accumulated energy at the heater 22 starts radiating within the duration Tu, and the corresponding temperature of the heater 22 is lowered. Therefore, the energy outputted from the heater 22 within one duration Tu when the heater 22 is activated again is less than the energy outputted from the heater 22 within one duration Tu before the related interruption. In addition, the energy outputted from the heater 22 is measured as a new energy unit to heat the color dyes when the heater 22 is activated again. Similarly, each pulse, after the interruption, will have different energy outputs within the same duration Tu, and the thermal accumulation effect also gives the later pulse 72 a higher energy output within the same duration Tu. The objective of step 102 to step 106 is to use the new energy unit to heat the color dyes so that a new gray level is generated after step 108. For example, when the heater 22 is activated continuously for N times, the energy outputted from the heater 22 within one duration Tu is equal to E. If the same heater 22 is deactivated for one duration Tu, the accumulated energy will radiate to make the heater 22 have a lower temperature than before. When the heater 22 is activated again, the energy outputted from the heater 22 within one duration Tu will be equal to 0.5*E. That is, a new gray level with a value "N+½" is interpolated between the gray level with a value "N" and the gray level with a value "N+1". Similarly, if the heater 22 is deactivated again for one duration Tu, the accumulated energy will radiate again to make the heater 22 have a much lower temperature than before. Then, the heater 22 is activated again, and the energy outputted from the heater 22 within one duration Tu will be equal to 0.25*E now. Finally, a new gray level with value "N+½+¼" is interpolated between the gray level with a value "N" and the gray level with a value "N+1". Please note that if the heater 22 is then activated for one duration Tu, the accumulated energy will be increased to make the heater 22 have a higher temperature than before. Then, the energy outputted from the heater 22 within one duration Tu will be equal to 0.5*E again.

As shown in FIG. 5, the color concentration of each pixel X3 is controlled by a corresponding predetermined gray level. When a plurality of heaters 22 are activated for heating corresponding pixels X3, the gray level is determined according to the total number of times the heater 22 is activated for heating the pixel X3. In addition, the combination of the first portion W and the second portion T is used for expressing the gray level. The first portion W represents a number with regard to successive activations of the same heater 22. Therefore, the color dye is continuously transferred onto a corresponding pixel X3 of the photo paper 16. The first portion W is greater than or equal to 0. The duration Tu of each heating operation is almost identical with acceptable inaccuracy. That is, the quantity of dyes transferred onto the photo paper 16 is almost the same within each pulse 72. The second portion T of the gray level corresponds to an interruption of the overall heating process. The heater 22 is deactivated within a plurality of durations Tu, then the heater 22 is activated once or is activated for a number of cycles with the same duration Tu. Within the fixed duration Tu, the quantity of color dyes transferred onto the photo paper 16 associated with the second portion T is less than the quantity of color dyes transferred onto the photo paper 16 associated with the first portion W. That is, the heating operations without any interruptions will generate a great deal of energy within one duration Tu for transferring color dyes onto the corresponding photo paper 16. The result is caused by the thermal accumulation effect as mentioned before. If the total number of times of successively activating the heater 22 is increased, much energy accumulates at the heater 22. Furthermore, the thermal accumulation effect with successive heating operations is greater than the thermal accumulation effect with interruptions induced during original consecutive heating operations. When the heater 22 is deactivated for one duration Tu or a plurality of durations Tu so as to break the consecutive heating operations, the energy generated from the heater 22 to heat the dyes within the duration Tu is reduced when the heater 22 is activated again. Similarly, when the heater 22 is activated again for heating the color dyes successively, each pulse 72 will have different energy output within the same duration Tu, and the thermal accumulation effect also makes the later pulse 72 with a higher energy output within the same duration Tu. As shown in FIG. 5, the printing method according to the present invention applies the above-mentioned principle to generate gray levels between the gray level with a value N and the gray level with a value "N+1". In the preferred embodiment, heating operations with proper interruptions are combined together for increasing the number of gray levels. The steps are described as follows.

Step 120:

Activate one heater 22 for a predetermined duration Tp so that the heater 22 approaches a predetermined temperature required for performing a printing operation properly;

Step 122:

Activate the heater 22 continuously for N times, that is, input N successive pulses having a binary value "1" to activate the heater 22;

Step 124:

Deactivate the heater 22 for two durations Tu, that is, input 2 pulses having a binary value "0" continuously to deactivate the heater 22;

Step 126:

Activate the heater 22 again for one duration Tu or a plurality of durations TU, that is, input at least one pulse to activate the heater 22 again; and Step 128:

Generate one gray level with a value "N+¼" to achieve the objective of increasing the number of gray levels.

As mentioned above, the objective of step 120 is to preheat the heater 22 so that the heater 22 can approach a required printing temperature. If the heater 22 is deactivated for two durations Tu after a long heating process, the accumulated energy at the heater 22 starts radiating within these two durations Tu, and the corresponding temperature of the heater 22 is lowered. Therefore, the energy outputted from the heater 22 within one duration Tu when the heater 22 is activated again is much less than the energy outputted from the heater 22 within one duration Tu before the related interruption. In addition, the energy outputted from the heater 22 is measured as a new energy unit to heat the color dyes after the heater 22 is activated again. Similarly, each pulse 72, after the interruption, will have different energy output within the same duration Tu, and the thermal accumulation effect also makes the later pulse 72 have a higher energy output within the same duration Tu. The objective of step 122 to step 126 is to use the new energy unit to heat the dyes so that a new gray level is generated after step 108. For example, when the heater 22 is activated continuously for N times, the energy outputted from the heater 22 within one duration Tu is equal to E. If the same heater 22 is deactivated for two durations Tu, the accumulated energy will radiate to make the heater 22 have a lower temperature than before. When the heater 22 is activated again, the energy outputted from the heater 22 within one duration Tu will be equal to 0.25*E. That is, a new gray level with a value "N+¼" is interpolated between the gray level with a value "N" and the gray level with a value "N+1". If the heater 22 is activated for one duration Tu again, the accumulated energy will be increased to make the heater 22 have a higher temperature than before. Then, the energy outputted from the heater 22 within one duration Tu will be equal to 0.5*E again. Finally, a new gray level with a value "N+¼+½" is interpolated between the gray level with a value "N" and the gray level with a value "N+1".

As shown in FIG. 6, the third printing method according to the present invention applies the above-mentioned principle to interpolate gray levels between gray level with a value "N" and gray level with a value "N+1". In the preferred embodiment, heating operations and proper interruptions are combined together to increase the number of gray levels. The steps are described as follows.

Step 130

Activate one heater 22 for a predetermined duration Tp so that the heater 22 approaches a predetermined temperature required for performing a printing operation properly;

Step 132: Activate the heater 22 continuously for N times, that is, input N pulses having a binary value "1" continuously to activate the heater 22;

Step 134: Deactivate the heater 22 for one duration Tu;

Step 136: Activate the heater 22 again for one duration Tu, that is, input one pulse having a binary value "1" to activate the heater 22 again;

Step 138: Deactivate the heater 22 for one duration Tu;

Step 140: Activate the heater 22 again for one duration Tu, that is, input one pulse having a binary value "1" to activate the heater 22 again; and Step 142: Generate one gray level with a value "N+¾" to achieve the objective of increasing the number of gray levels.

As mentioned above, the objective of step 130 is to preheat the heater 22 so that the heater 22 can approach a required printing temperature. If the heater 22 is deactivated for one duration Tu after a long heating process, the accumulated energy at the heater 22 starts radiating within the duration Tu, and the corresponding temperature of the heater 22 is lowered. Therefore, the energy outputted from the heater 22 within one duration Tu when the heater 22 is activated again is less than the energy outputted from the heater 22 within one duration Tu before the related interruption. In addition, the energy outputted from the heater 22 is measured as a new energy unit to heat the color dyes after the heater 22 is activated again. Similarly, each pulse 72, after the interruption, will have different energy outputs within the same duration Tu, and the thermal accumulation effect also makes the later pulse 72 have a higher energy output within the same duration Tu. The objective of step 132 to step 140 is to use the new energy unit to heat the dyes so that a new gray level is generated after step 142. For example, when the heater 22 is activated continuously for N times, the energy outputted from the heater 22 within one duration Tu is equal to E. If the same heater 22 is deactivated for one duration Tu, the accumulated energy will radiate to make the heater 22 have a lower temperature than before. When the heater 22 is activated again, the energy outputted from the heater 22 within one duration Tu will be equal to 0.5*E. Similarly, if the heater 22 is deactivated again for one duration Tu, the accumulated energy will radiate again to make the heater 22 have a much lower temperature than before. Then, the heater 22 is activated again, and the energy outputted from the heater 22 within one duration Tu will be equal to 0.25*E. Finally, a new gray level with a value "N+½+¼" is interpolated between the gray level with a value "N" and the gray level with a value "N+1".

From the disclosure mentioned in the first, second, and third printing methods according to the present invention, each heater 22 can acquire other gray levels between any two successive gray levels such as the gray level with a value "N" and the gray level with a value "N+1". Therefore, all the heaters 22 can output a plurality of gray levels within original 255 durations Tu with a proper control to activate or deactivate the heaters 22. The number of different gray levels is greatly increased without additional operation time. On the other hand, if the number of different gray levels such as 255 is fixed, the heater 22 can generate the required gray level within a smaller number of durations Tu by controlling a proper sequence of activating or deactivating the heater 22. Please refer to the following table.

| Gray level | Driving signal | | | | |
|---|---|---|---|---|---|
| 0 | 1 | 0 | 0 | 0 | 0 |
| 1 | 1 | 0 | 1 | 0 | 0 |
| 2 | 1 | 1 | 0 | 0 | 0 |
| 3 | 1 | 1 | 1 | 0 | 0 |
| 4 | 1 | 1 | 1 | 0 | 1 |
| 5 | 1 | 1 | 1 | 1 | 0 |
| 6 | 1 | 1 | 1 | 1 | 1 |

The driving signal with a binary value "0" is used for deactivating the heater 22, and the driving signal with a binary value "1" is used for activating the heater 22. Each gray level corresponds to different binary data sequences. For example, the heater 22 used for heating the dyes is driven by the driving signal. As mentioned before, the heater 22 must be preheated first to reach the predetermined printing temperature. If the driving signal has a binary data sequence "1", "0", "0", "0", "0", the heater 22 is first activated for the duration Tp, then is deactivated for successive four durations Tu. Please note that the binary value "1" in the beginning of the driving signal represents the preheating operation. Therefore, a corresponding gray level with a value "0" is generated. If the driving signal has a binary data sequence "1", "0", "1", "0", "0", the heater 22 is activated once after the preheating operation. Therefore, the heater 22 related to the gray level with a value "1" will transfer more dyes onto the photo paper 16 than the heater 22 related to the gray level with a value "0". If the driving signal has a binary data sequence "1", "1", "0", "0", "0", the heater 22 is activated once after the preheating operation, too. Therefore, the heater 22 related to the gray level with a value "2" is activated continuously after the preheating operation so that the heater 22 related to the gray level with a value "2" will transfer more dyes onto the photo paper 16 than the heater 22 related to the gray level with a value "1". Similarly, the heater 22 related to the gray level with a value "3" is activated twice after the preheating operation so that the heater 22 related to the gray level with a value "3" will transfer more dyes onto the photo paper 16 than the heater 22 related to the gray level with a value "2". As shown in the table, one heater 22 only requires an operation time equaling Tp+4*Tu to transfer dyes onto the photo paper 16 according to any of the six different gray levels. However, the prior art printing method needs the operation time equaling TP+6*Tu to transfer dyes onto the photo paper 16 according to any of the six different gray levels. Please note that only six gray levels are shown in the table for simplicity, and the claimed printing method is not limited to only six gray levels. That is, the claimed printing method can be used for generating a fixed number of different gray levels with a shorter operation time or generating a greater number of different gray levels with a fixed operation time when compared with the prior art printing method.

Furthermore, the photo printer 10 mentioned above further comprises a fixture (not shown) to hold and move the photo paper 16. The thermal print head 12 is fixed inside the photo printer 10 to transfer the color dyes onto the photo paper 16. In addition, the thermal print head 12 can be movably positioned inside the photo printer 10, and the fixture is used for fixing the photo paper 16. Then, the thermal print head 12 is gradually moved to transfer the color dyes onto the photo paper 16 line by line.

In contrast to the prior art printing method, the claimed printing method makes use of the thermal accumulation effect to interpolate new gray levels between original successive gray levels. On one hand, each pixel on the photo paper will have a better color resolution because of the increased gray levels when the required printing time for one line is fixed. On the other hand, the printing speed is improved because the printing time for one line is reduced when the required number of gray levels is fixed. In conclusion, the claimed printing method can improve output quality and printing efficiency.

Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A printing method using a thermal print head having a plurality of heaters linearly arranged and equally spaced for heating a dye and transferring the dye onto an object, thereby forming a plurality of pixels corresponding to the heaters on the object, a color of each pixel being determined by a gray level, each gray level comprising a first portion and a second portion, wherein when controlling the heater to generate a pixel of a predetermined gray level, the printing method comprises:

activating a heater for a number of cycles corresponding to the first portion of the predetermined gray level, thereby transferring the dye onto the object in a position corresponding to the heater, wherein the first portion is larger than or equal to zero, each cycle lasts a substantially equal amount of time, each activation of the heater within a cycle lasts a substantially equal amount of time, and a quantity of the dye transferred onto the object is substantially equal for each activation of the heater; and deactivating the heater for a first predetermined number of cycles corresponding to the second portion of the predetermined gray level, then activating the heater a second predetermined number of cycles corresponding to the second portion of the predetermined gray level, wherein both the first predetermined number and the second predetermined number are integers larger than or equal to 1, a total quantity of the dye transferred onto the object in printing the second portion of the predetermined gray level is less than the quantity of dye transferred onto the object during each cycle of printing in first portion of the predetermined gray level.

2. The printing method of claim 1 wherein the second portion of the predetermined gray level is printed after the first portion of the predetermined gray level has finished.

3. The printing method of claim 1 wherein before the thermal print head prints the first portion of the predetermined gray level for any of the pixels, the printing method further comprises:

activating each of the heaters simultaneously for a predetermined period, causing the heaters of the thermal print head to reach a predetermined temperature.

4. The printing method of claim 1 wherein the thermal print head is arranged in a printer, and the printer further comprises a fixture for fixing and moving the object whereby the thermal print head transfers a pattern onto the object.

5. The printing method of claim 4 wherein the printer is a photo printer, the dye is carried on a ribbon, and the object is a photo paper.

6. The printing method of claim 1 wherein the thermal print head is moveably arranged in a printer, and the printer further comprises a fixture for fixing the object, and the thermal print head transfers a pattern onto the object one line at a time.

7. The printing method of claim 1 wherein a sum of the number of cycles for activating the heater according to the first portion, the first predetermined number of cycles for deactivating the heater according to the second portion, and the second predetermined number of cycles for activating the heater according to the second portion is less than a total number of different gray levels.

8. The printing method of claim 1 wherein if the number of cycles for activating the heater according to the first portion is increased, an amount of the dye transferred onto the object is increased for raising the corresponding gray level.

9. A printer comprising:

a fixture for fixing an object; and a thermal print head comprising a plurality of heaters linearly arranged and equally space for heating a dye so as to transfer the dye onto the object; wherein the thermal print head forms a plurality of pixels on the object corresponding to the heaters, a color of each pixel is determined by a gray level resolution, each gray level comprising a first portion and a second portion, wherein when the printer controls the heater to generate a pixel of a predetermined gray level, the thermal print head activates a heater repeatedly in a number of cycles corresponding to the first portion of the predetermined gray level, thereby transferring the dye onto the object in a position corresponding to the heater, wherein the first portion is larger than or equal to zero, each cycle lasts a substantially equal amount of time, each activation of the heater within a cycle lasts a substantially equal amount of time, and a quantity of the dye transferred onto the object is substantially equal for each activation of the heater, and then the thermal print head deactivates the heater for a first predetermined number of cycles according to the second portion of the predetermined gray level, and thereafter activates the heaters a second predetermined number of cycles, both the first predetermined number and the second predetermined number are integers larger than or equal to 1, a total quantity of the dye transferred onto the object in printing the second portion of the predetermined gray level is less than the quantity of the dye transferred onto the object during each cycle of printing in the first portion of the predetermined gray level.

10. The printer of claim 9, wherein before the thermal print head prints the first portion of the predetermined gray level for any of the pixels, the thermal print head turns on each of the heaters simultaneously for a predetermined period, causing the heaters of the thermal print head reach a predetermined temperature.

11. The printer of claim 9, wherein the fixture moves the object so that the thermal print head transfers a pattern onto the object.

12. The printer of claim 11 is a photo printer, the dye is carried on a ribbon, and the object is a photo paper.

13. The printer of claim 9, wherein the thermal print head is moveably arranged in the printer, and the thermal print head transfers a pattern onto the object one line at a time.

14. The printer of claim 9 wherein a sum of the number of cycles for activating the heater according to the first portion, the first predetermined number of cycles for deactivating the heater according to the second portion, and the second predetermined number of cycles for activating the heater according to the second portion is less than a total number of different gray levels.

15. The printer of claim 9 wherein if the number of cycles for activating the heater according to the first portion is increased, an amount of the dye transferred onto the object is increased for raising the corresponding gray level.

* * * * *